US007328822B2

(12) United States Patent
Stokes

(10) Patent No.: US 7,328,822 B2
(45) Date of Patent: Feb. 12, 2008

(54) CLOTHES HANGER WITH ADJUSTABLE ARMS

(76) Inventor: Viette Marguerite Stokes, 2573 7th Ave., Apt. 10-I, New York, NY (US) 10039

( * ) Notice: Subject to any disclaimer, the term of this patent is extended or adjusted under 35 U.S.C. 154(b) by 270 days.

(21) Appl. No.: 10/943,473

(22) Filed: Sep. 17, 2004

(65) Prior Publication Data

US 2005/0092787 A1 May 5, 2005

Related U.S. Application Data

(60) Provisional application No. 60/506,866, filed on Sep. 30, 2003.

(51) Int. Cl.
*A41D 27/22* (2006.01)

(52) U.S. Cl. ..... 223/94; 223/85; 223/89

(58) Field of Classification Search ..... 223/85, 223/88, 89, 94; 211/85.3; D6/315, 318; 403/109.1, 109.2, 109.3
See application file for complete search history.

(56) References Cited

U.S. PATENT DOCUMENTS 2,446,312 A * 8/1948 Usina ..... 223/89
2,494,711 A * 1/1950 Hyman et al. ..... 223/94
2,500,817 A * 3/1950 Glassmeyer ..... 223/89
2,538,971 A * 1/1951 Leumi ..... 223/89
2,620,102 A * 12/1952 Bremer ..... 223/89
2,637,471 A * 5/1953 Goldschmidt et al. ..... 223/89
2,817,471 A * 12/1957 Stoschy ..... 223/90
2,900,117 A * 8/1959 Veltry ..... 223/94
3,148,808 A * 9/1964 Griffin et al. ..... 223/86
5,082,152 A * 1/1992 Chen ..... 223/89
5,145,098 A * 9/1992 Tung ..... 223/94
5,480,075 A * 1/1996 Robinson ..... 223/88
5,598,957 A * 2/1997 Bell ..... 223/94
5,941,429 A * 8/1999 Koons ..... 223/94
6,079,894 A * 6/2000 Obitts ..... 403/109.3
6,213,672 B1 * 4/2001 Varga ..... 403/109.2
6,688,503 B2 * 2/2004 Viazanko et al. ..... 223/89
6,722,538 B1 * 4/2004 Autry et al. ..... 223/94
6,854,916 B2 * 2/2005 Hsieh ..... 403/109.3
7,077,300 B1 * 7/2006 Di Pietro ..... 223/89

* cited by examiner

*Primary Examiner*—Gary L. Welch
*Assistant Examiner*—Nathan E Durham

(57) ABSTRACT

An extendable clothes hanger comprising a hook portion, opposed rigid side arms and opposed extension sleeves that are slidably mounted to the side arms and are movable between selected an extended mode and several selected extended modes. The extension sleeves can be selectively locked either at the unextended or extended modes wherein the extension sleeves are locked by pins relative to the side arms and can be unlocked so that the first and second sleeves are movable relative to the side arms. One embodiment includes solid rectangular arms and hollow rectangular sleeves and another embodiment includes a cylindrical arms enclosed by cylindrical sleeves. Bracing pins can be optionally included to activate when the sleeves are in their fully extended modes.

11 Claims, 13 Drawing Sheets

CLOTHES HANGER WITH ADJUSTABLE ARMS

PRIOR FILING

Provisional application No. 60/506,866 relating to this application was filed on Sep. 30, 2003, entitled The X-tendable Hanger.

BACKGROUND OF THE INVENTION

1. Field of the Invention

The present invention relates to clothes hangers and in particular to hangers used in women's clothing particularly in the fashion industry with the invention also being usable for men's clothing.

2. Prior Art

Women's clothing in the fashion industry has a wide variation of dress and coat designs from narrow shoulders to very wide shoulders. In order to avoid wrinkling or folds or deformities it is advantageous that the hangers can be adjusted.

Prior art patents that disclose adjustable clothes hangers include the following:

U.S. Pat. No. 4,905,877 issued to Gatling on Mar. 6, 1990, describes an adjustable hanger having a pair of opposed biasable arms having upper and lower segments and a pair of sleeves slidable about the arms when the arms are in a spring biased mode and being held in an affixed positions when the arms are in a spring biased mode. Each sleeve has a plurality of spaced stop receiving means for receiving an arm stop means when the arms are in a spring biased mode. Each of the stop receiving means for both arms is located in the bottom segments of the arms. Support blocks are mounted beneath and adjacent to the top segments to limit movement of the arms away from the centerline of the hanger.

U.S. Pat. No. 5,476,199 issued to Halverson et al. on Dec. 19, 1995, discloses an extendable clothes hanger with left and right side arms and left and right extension arms positioned above the left and right side arms. Left and right side arm gripping means removably and slidably couple the right and left extension arms to the left and right side arms so as to adjust the lateral extent of the hanger.

U.S. Pat. No. 6,179,174 issued to Kandl on Jan. 30, 2001, discloses an adjustable hanger comprising a V-shaped hanger with a hook portion and two angled shafts connected to the hook portion and a pair of V-shaped connectors and an engagement tube with the two angled shafts being slidably and frictionally engagable with the two angled shafts and the engagement tube. An alternate embodiment comprises a three-piece hanger that eliminates the separate engagement tube of the preferred embodiment.

U.S. Pat. No. 5,975,385 issued to See on Nov. 2, 1999, discloses an adjustable clothes hanger that includes a rotatable hook that operates a rack and pinion that extends and retracts in accordance with the rotation of the hook.

SUMMARY OF THE INVENTION

It is an object of the present invention to provide an adjustable clothes hanger that is directed to the fashion industry and that can be quickly and easily adjusted to provide support to women's coats and dresses and also to men's coats over a wide variation of sizes and designs.

It is a further object of the present invention to provide a clothes hanger that can be quickly and easily selectively adjusted so as to widen or shorten the side support arms of the hanger.

It yet another object of the present invention to provide a clothes hanger that can be adjusted by sliding an extension sleeve along each opposed side arm and then locking each extension sleeve at a selected distance from the hook portion of the hanger.

The present invention provides an extendable clothes hanger comprising a hook portion, opposed rigid side arms and opposed extension sleeves that are slidably mounted to the side arms and are movable between sleeve unextended modes and sleeve extended modes. The extension sleeves can be selectively locked either at the unextended or extended modes wherein the extension sleeves are immovable relative to the side arms and can be unlocked so that the first and second sleeves are movable relative to the side arms. A locking pin transverse to each side arm is mounted to the bottom side of each side arm. Each extension sleeve includes an extension sleeve bottom side that defines one inward aperture and at least one outward aperture with the inward aperture being associated with each sleeve unextended mode and the outward aperture being associated with each sleeve extended mode. The locking pins are selectively positioned in the inward apertures or the outward apertures so as to removably engage the side arms with the extension sleeves. Each extension sleeve further defines a plurality of intermediate locking apertures between the inward aperture and the outward aperture and each locking pin can be selectively positioned in any of the plurality of locking apertures. Each locking pin includes an expansion spring movable between spring biased and unbiased modes wherein in the spring biased mode the locking pin is withdrawn from the locking apertures of the extension sleeves and in the spring unbiased mode each locking pin is positioned in the locking apertures of the extension sleeves so as to engage the extension sleeves from lateral movement relative to the side arms. In addition, each top side of each side arm has a bracing pin that can be moved between a spring biased mode and a spring unbiased mode and when each extension sleeve is positioned in the fully extended mode. Each sleeve tends to turn about the end of each hanger arm, which acts as a fulcrum in accordance with the principle of the lever, particularly in the fully extended mode of each sleeve when the weight of hanging clothing maximizes the downward leverage effect at the end of each arm. The bracing pins positioned towards the ends of each arm act as restraints for the sleeves from such downward rotational movement in the vertical planes defined by the hanger arms in the fully extended modes of the first and second sleeves. The locking pins are positioned on the bottom sides of the arms so as not to catch on fabric on the top sides. The bracing pins are positioned on the top sides of the arms for advantageous functional hold-down for restraining downward leveraging of the sleeves. Each bracing pin is spring biased through a bracing pin aperture defined in the top side of each extension sleeve so that each bracing pin provides additional stability to each extension sleeve.

Another embodiment of the present invention includes a first cylindrical rigid side arm and a first extension sleeve is a first cylindrical extension sleeve slidably positioned around the first cylindrical side arm, and wherein the second rigid side arm is a second cylindrical rigid side arm and the second extension sleeve is a second cylindrical extension sleeve slidably positioned around the second cylindrical side arm.

The present invention will be better understood and the objects and important features, other than those specifically set forth above, will become apparent when consideration is given to the following details and description, which when taken in conjunction with the annexed drawings, describes, illustrates, and shows preferred embodiments or modifications of the present invention and what is presently considered and believed to be the best mode of practice in the principles thereof.

DETAILED DESCRIPTION OF THE PREFERRED EMBODIMENT

Figure 1A:
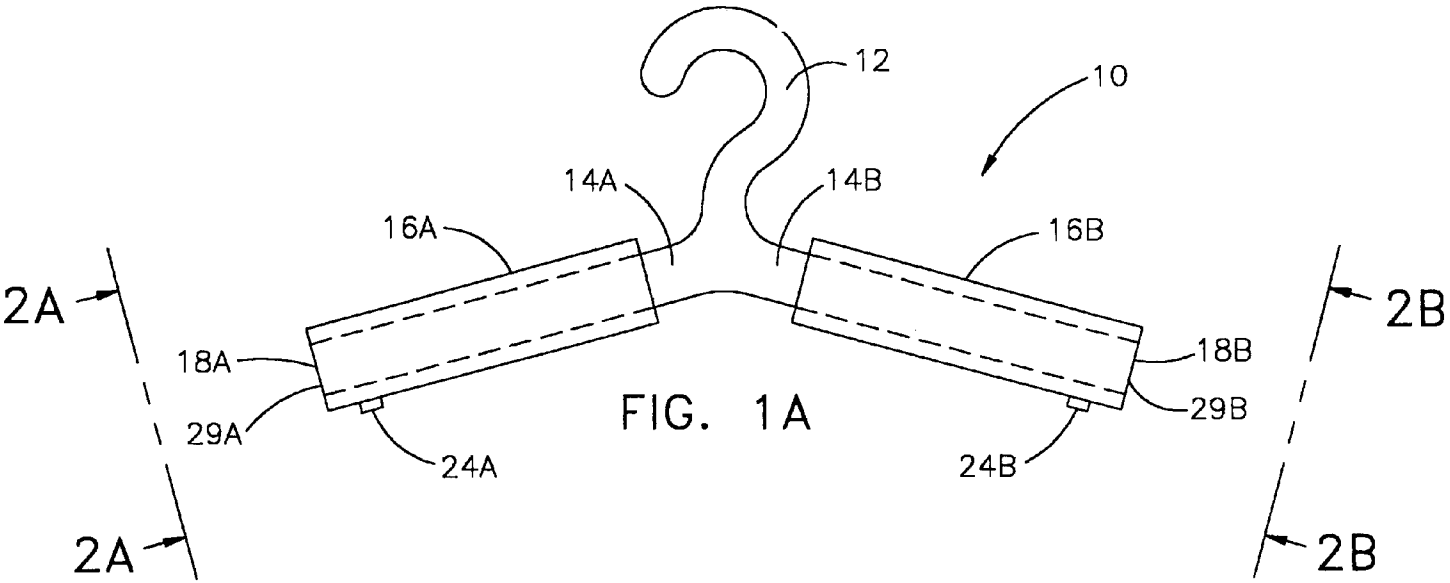
FIG. 1A is a front elevation view of a clothes hanger in accordance with the present invention showing left and right side arms and left and right extension sleeves in an unextended mode.

Reference is now made to the drawings in which identical or similar parts are designated by the same reference numerals throughout.

Figure 1B:
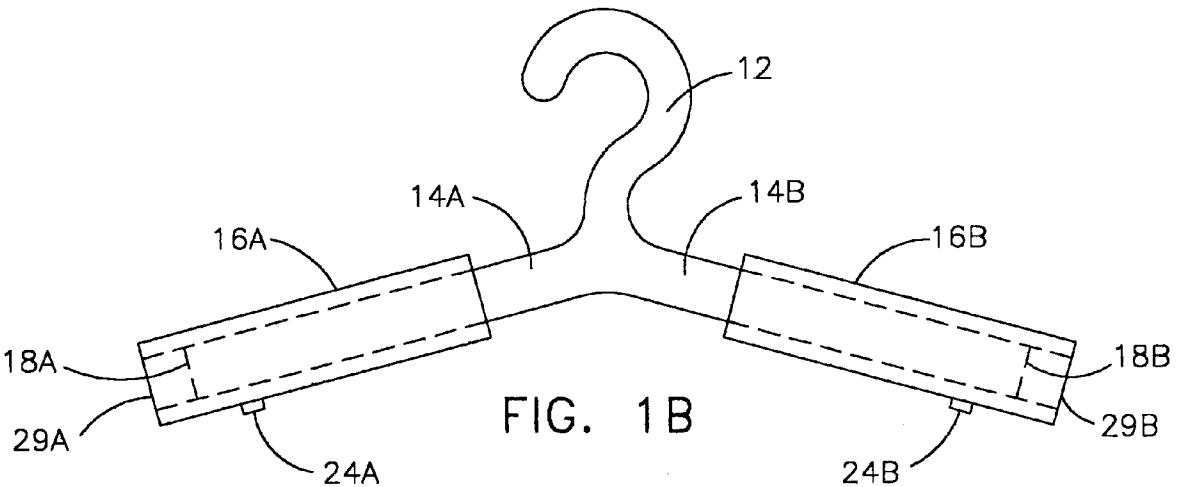
FIG. 1B is a front elevation view of the hanger shown in FIG. 1A showing the left and right extension sleeves extending from the left and right side arms in a first extended mode.
Figure 1C:
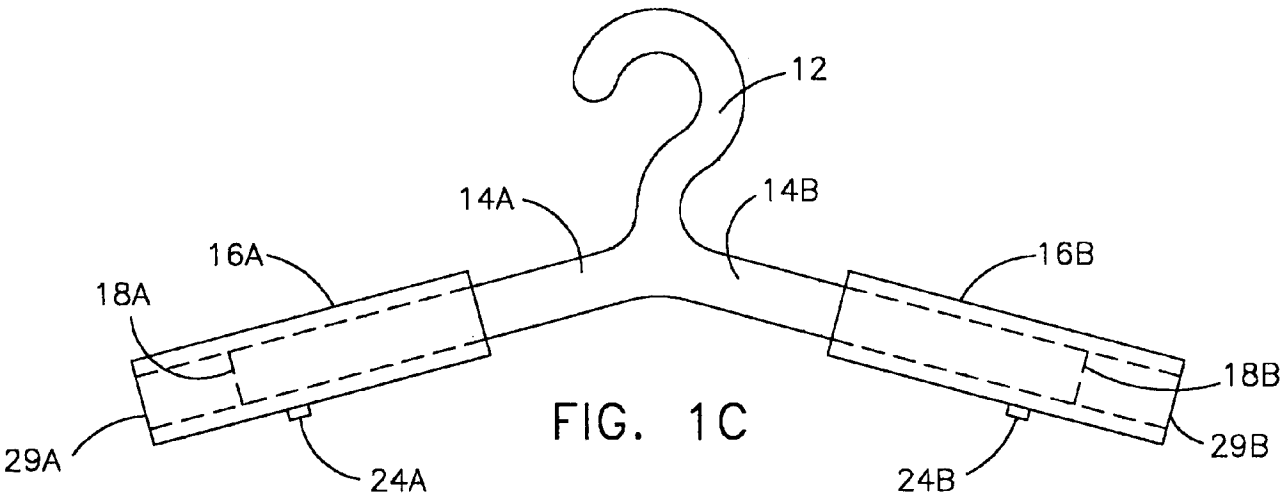
FIG. 1C shows a front elevation view of the invention showing the left and right extension sleeves extending from the left and right side arms in a second extended mode.
Figure 1D:
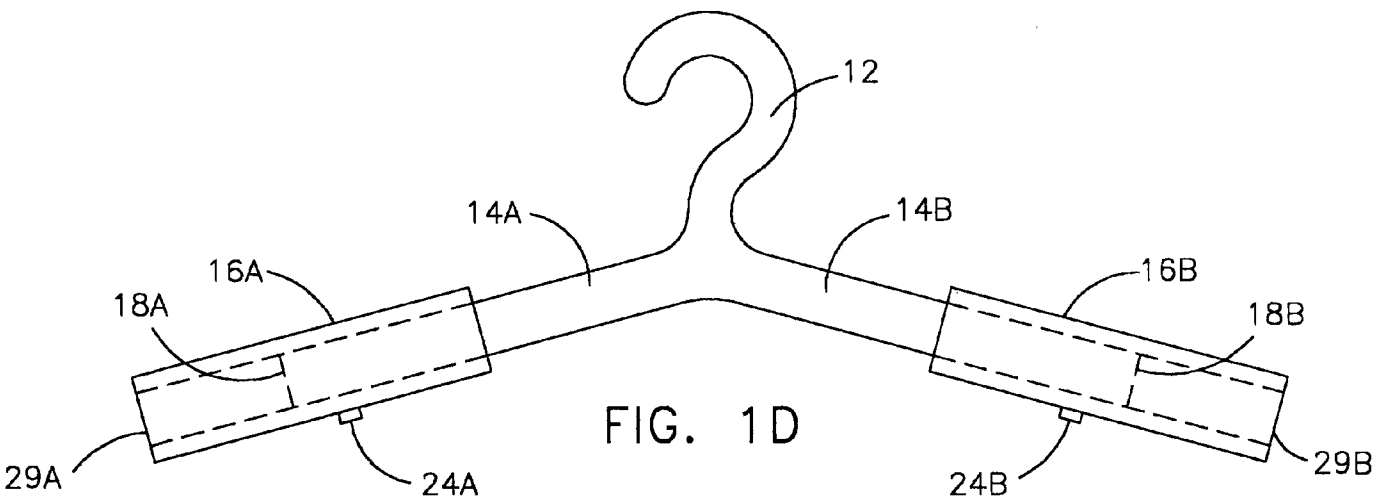
FIG. 1D shows a front elevation view of the invention showing the left and right extension sleeves extending from the left and right side arms in a third extended mode.
Figure 1E:
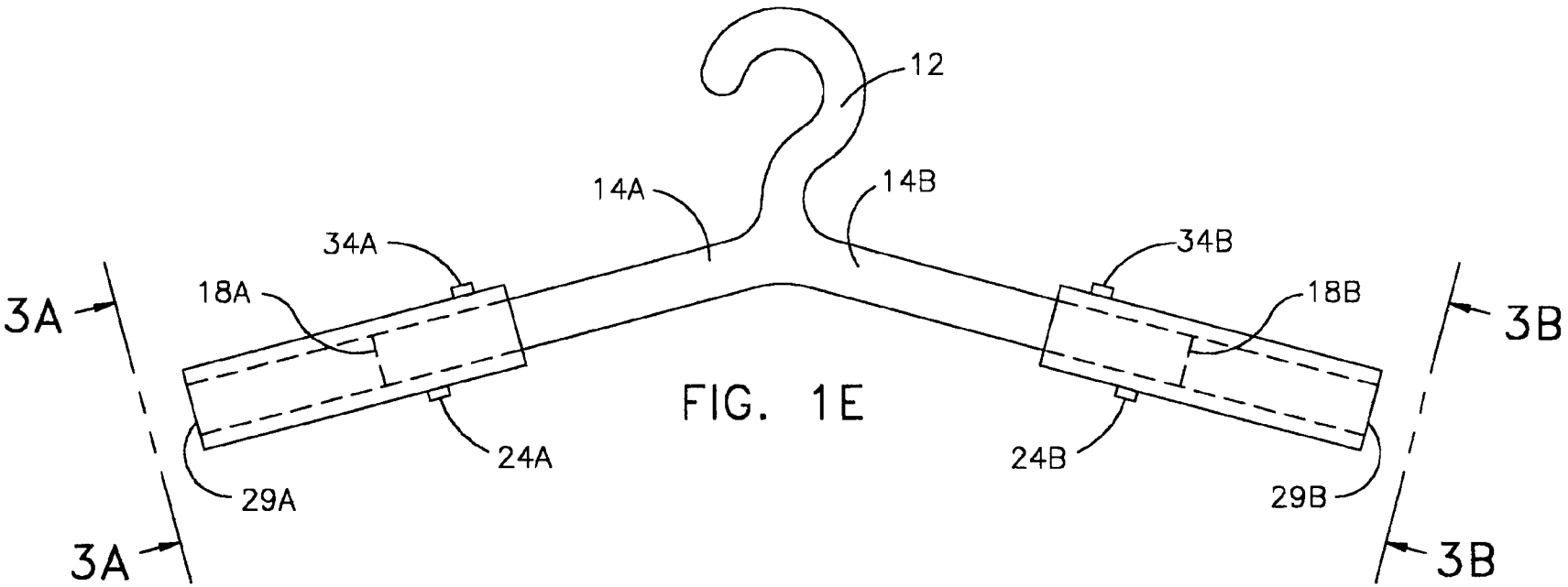
FIG. 1E shows a front elevation view of the invention showing the left and right extension sleeves extending from the left and right side arms in a fully extended mode.

As shown in FIGS. 1A-1E an extendable clothes hanger 10 includes a hook portion 12 and a linear side arm 14A and an opposed linear side arm 14B that are both connected to hook portion 12. A linear extension sleeve 16A slidably mounted to side arm 14A is movable between an inward unextended mode as shown in FIG. 1A and an outward fully extended mode as shown in FIG. 1E. Another linear extension sleeve 16B slidably mounted to side arm 14B is movable between an inward unextended mode as shown in FIG. 1A and an outward fully extended mode as shown in FIG. 1E. Linear side arms 14A and 14B are shown slightly angled downwardly relative to the horizontal in a manner that is known in the art.

Figure 4:
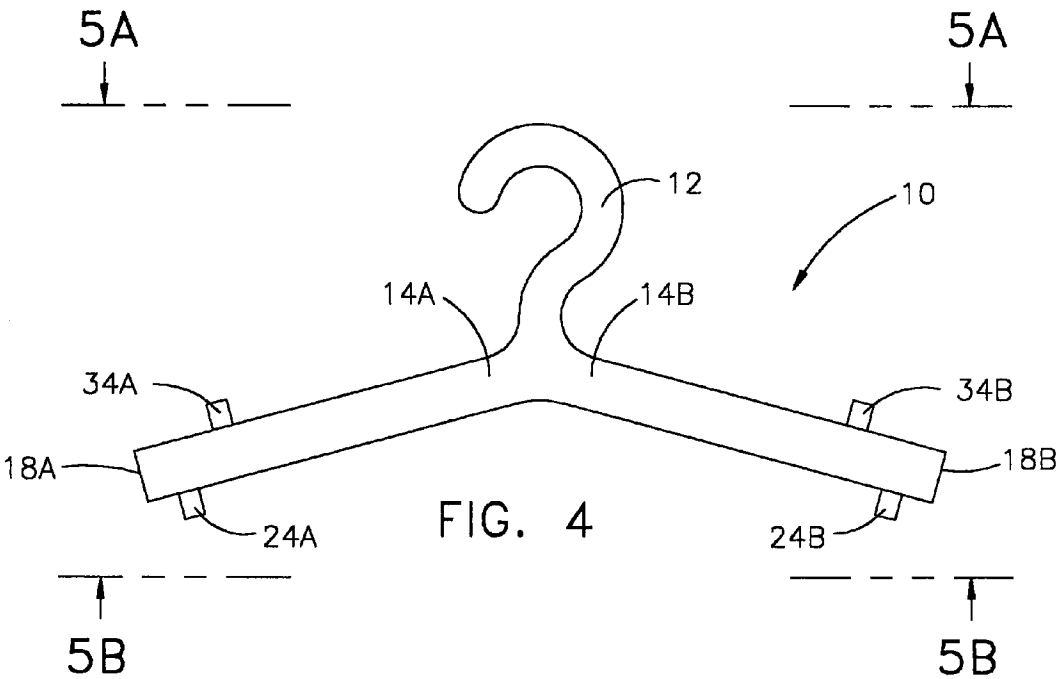
FIG. 4 shows a front elevation isolation view of the unitary hook portion and left and right side arms shown FIG. 1.
Figure 5A:
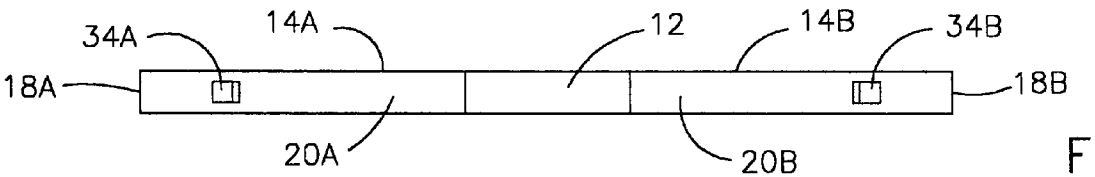
FIG. 5A shows a top view taken through line 5B-5B of FIG. 4.
Figure 5B:
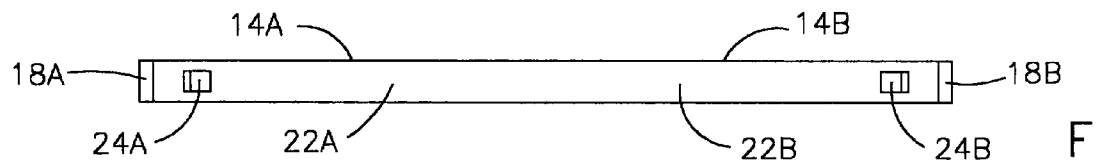
FIG. 5B shows a top view of FIG. 5 taken through line 5B-5B.

Hook portion 12 and side arms 14A and 14B are shown in isolated views in FIGS. 4, 5A and 5B. Side arm 14A has an outer end 18A and a side arm top side 20A and a side arm bottom side 22A, and side arm 14B has an outer end 18B and a side arm top side 20B and a side arm bottom side 22B.

Figure 10:
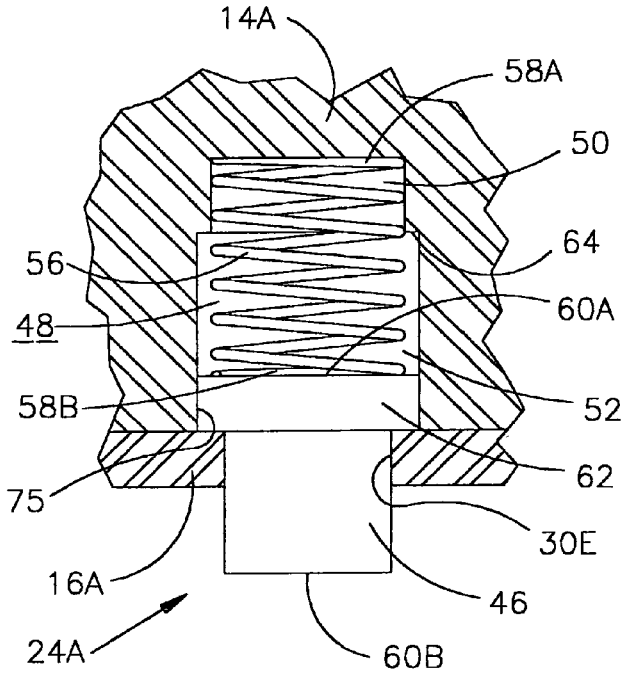
FIG. 10 is a sectional view of the locking pin in the spring unbiased locked mode taken through line 10-10 in FIG. 9.
Figure 9:
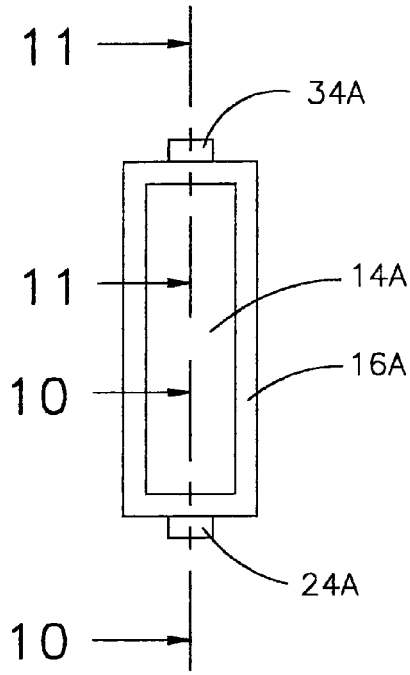
FIG. 9 is an isolated detailed side view of the left side arm and the left extension sleeve of the view shown in FIG. 1E.
Figure 10A:
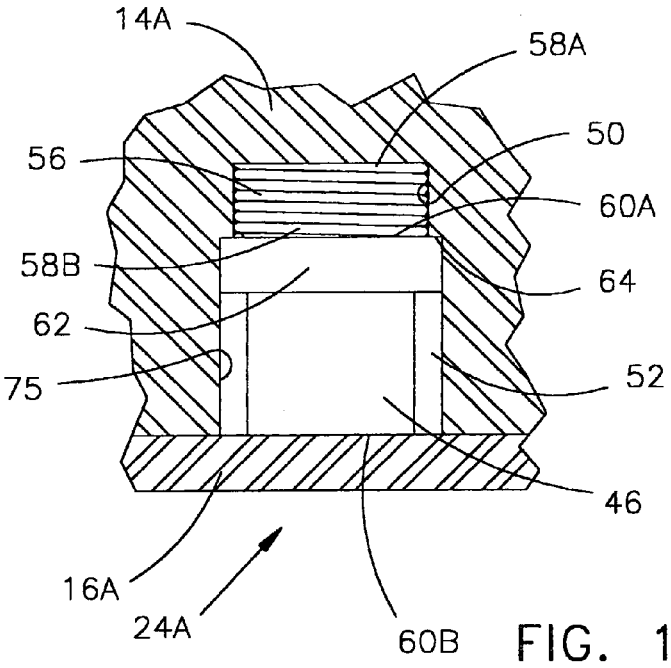
FIG. 10A is a view analogous to the view shown in FIG. 10 with the locking pin shown in the spring biased unlocked mode.

FIGS. 4 and 5A show a locking pin 24A that is mounted to bottom side 22A of side arm 14A proximate to side arm outer end 18A. Locking pin 24A is shown as rectangular but it can be cylindrical. Isolated views of locking pin 24A are shown in FIGS. 9, 10 and 10A, which correlates with FIGS. 2A, 2B, 3A, and 3B. Locking pin 24A is transverse to side arm 14A and is movable between a spring biased mode and a spring unbiased mode, wherein in the spring biased mode locking pin 24A is distanced from side arm bottom side 22A in the manner shown in FIGS. 9 and 10 and wherein in the spring biased mode locking pin 24A is withdrawn from side arm bottom side 22A as shown in FIG. 10A. FIGS. 4 and 5B also show a locking pin 24B that is mounted to bottom side 22B of side arm 14B proximate to side arm outer end 18B. Isolated views of locking pin 24B are shown in FIGS. 9, 10 and 10A. In the same manner as locking pin 24A, locking pin 24B is transverse to side arm 14B and is movable between a spring mode and a spring unbiased mode, wherein in the spring unbiased mode locking pin 24B is distanced from side arm bottom side 22B in the manner shown in FIGS. 9 and 10 and wherein in the spring biased mode locking pin 24B is withdrawn from side arm bottom side 22B as shown in FIG. 10A.

In FIGS. 4, 5A and 5B in the isolated view of hook portion 12 with side arms 14A and 14B, locking pins 24A and 24B are in the spring unbiased mode. When extension sleeves 16A and 16B are mounted to side arms 14A and 14B, locking pins 24A and 24B are in the spring biased mode after being pressed manually inwardly relative to side arm bottom sides 22A and 22B during the manual operation of sliding extension sleeves 16A and 16B relative to side arms 14A and 14B during the movements shown relative to FIGS. 1A-1E as can be seen n FIG. 10A.

Figure 2A:
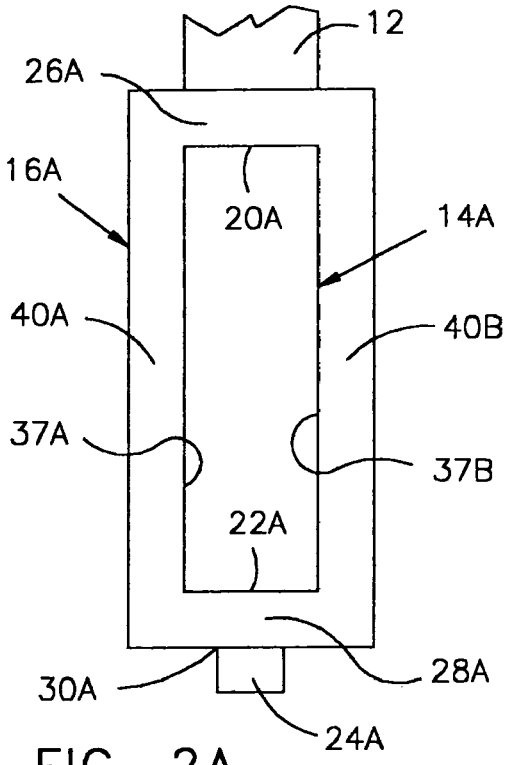
FIG. 2A shows a view taken through line 2A-2A of FIG. 1A.

As seen in FIG. 2A, side arm 14A has opposed sides 37A and 37B that are connected with opposed top and bottom sides 20A and 22A so that side arm 14 is an elongated rectangle. Opposed sides 37A and 37B are greater in dimension than top and bottom sides 20A and 22A.

Extension sleeve 16A has opposed side walls 40A and 40B and with opposed top and bottom wall 26A and bottom wall 28 forms an elongated rectangular compartment A (FIG. 6A) within which side arm 14A is slidably mounted.

Extension sleeve 16A has opposed side walls 40A and 40B and with opposed top and bottom wall 26A and bottom wall 28 forms an elongated rectangular compartment 42B (FIG. 6A) within which side arm 14B is slidably mounted.

Figure 2B:
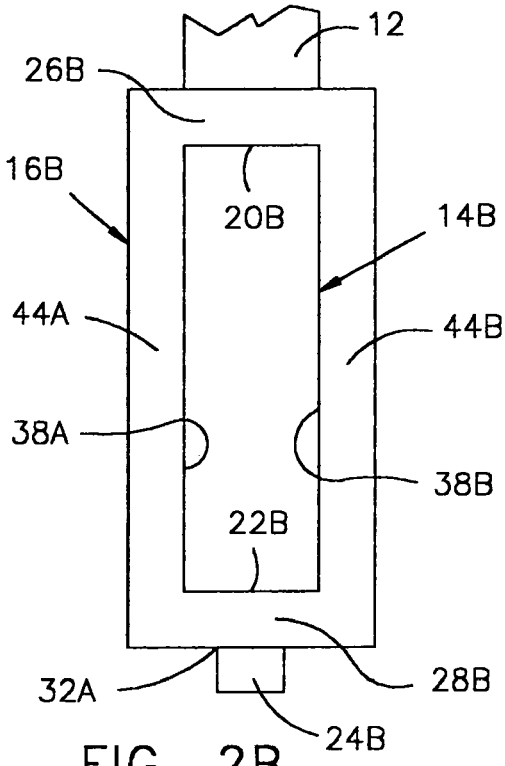
FIG. 2B shows a view taken through line 2B-2B of FIG. 1A.
Figure 3A:
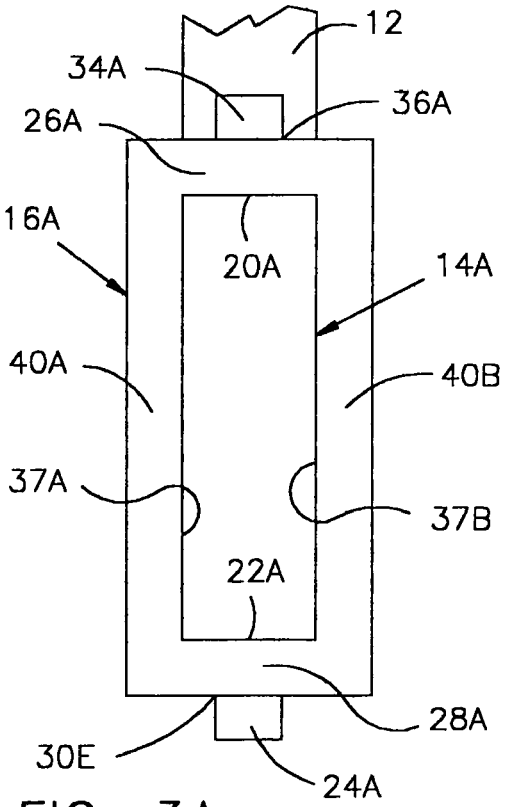
FIG. 3A shows a left side view taken through line 3A-3A of FIG. 1E.
Figure 3B:
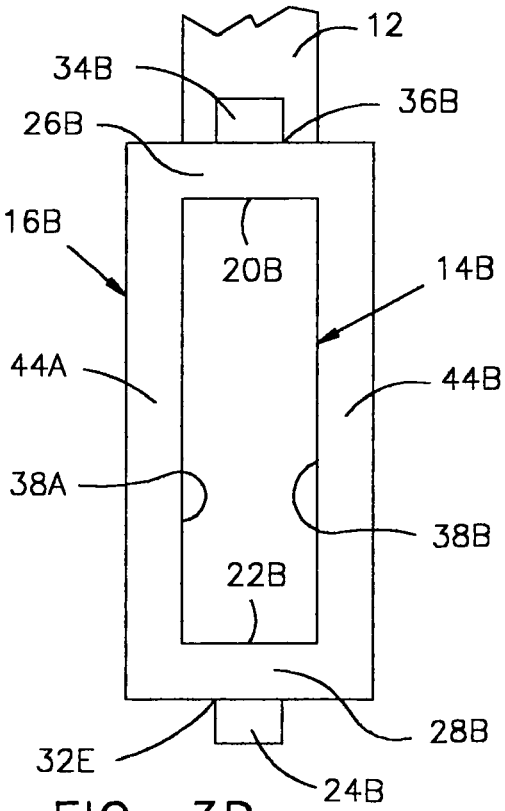
FIG. 3B shows a view taken through line 3B-3B of FIG. 1E.

As seen in FIG. 2B, side arm 14B has opposed sides 38A and 38B that are connected with opposed top and bottom sides 20B and 22B so that side arm 14B is an elongated rectangle. Opposed sides 38A and 38B are greater in dimension than top and bottom sides 20B and 22B.

Extension sleeve 16B has opposed side walls 48A and 48B and opposed top wall and bottom walls 50A and 50B, respectively. Side walls 48A and 48B and top and bottom walls 50A and 50B define an elongated rectangular compartment 44B (FIG. 6B) in which side arms 14A and 14B are slidably mounted.

FIGS. 6A and 6B, FIGS. 7A and 7B, and FIGS. 8A and 8B show elongated extension sleeve 16A and elongated extension sleeve 16B having outer ends 29A and 29B, respectively. Bottom wall 28A of extension sleeve 16A defines rectangular equally spaced sleeve locking apertures 30A, 30B, 30C, 30D and outermost sleeve locking aperture 30E proximate to side arm outer end 18A. Bottom wall 28B of extension sleeve 16B defines rectangular innermost sleeve equally spaced sleeve locking apertures 32A, 32B, 32C, 32D and outermost sleeve locking aperture 32E proximate to side arm outer end 18B.

Innermost sleeve locking aperture 30A of extension sleeve 16A is associated with the unextended mode of extension sleeve 16A as seen in FIG. 1A wherein locking pin 24A is positioned in a spring unbiased locked mode in innermost sleeve locking aperture 30A. Locking pin 24A is positioned in spring unbiased modes in succeeding sleeve locking apertures 30B, 30C, 30D and outermost sleeve locking aperture 30E as shown in FIGS. 1B, 1C, 1D and 1E, respectively. In the spring biased mode, locking pin 24A is withdrawn from side arm 14A bottom side 22A and in the spring unbiased mode locking pin 24A is extended past side arm bottom side 22A so as to enter any of the selected sleeve locking apertures 30A-E. Thus, extension sleeve 16A is selectively extendable between a selective innermost mode as seen in FIG. 1A and a selective outermost mode as seen in FIG. 1E with three selective intermediate extension modes of side arm 14A as shown in FIGS. 1B, 1C and 1D, respectively. (See FIG. 10A.)

Figures 6A, 6B, 7A, 7B, 8A, 8B:
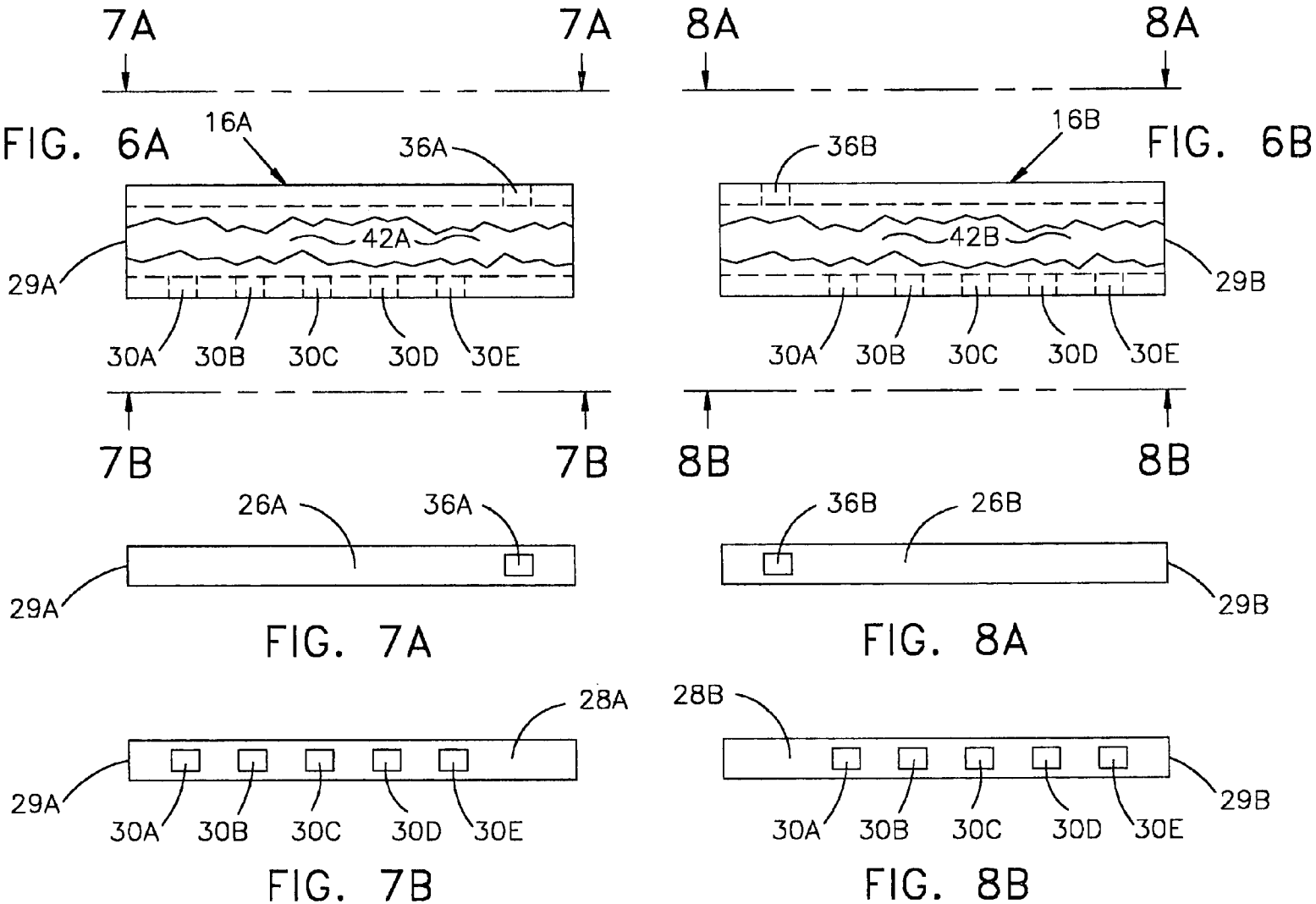
FIG. 6A shows an isolation front elevation view of the left extension sleeve of the hanger shown in FIG. 1.
FIG. 6B shows an isolation front elevation view of the right extension sleeve of the hanger shown in FIG. 1.
FIG. 7A shows a top view of FIG. 6A taken through line 7A-7A.
FIG. 7B shows a bottom view of FIG. 6A taken through line 7B-7B.
FIG. 8A shows a top view of FIG. 6B taken through line 8A-8A.
FIG. 8B shows a bottom view of FIG. 6B taken through line 8B-8B.

In the unextended modes of extension sleeves 16A and 16A as shown in FIG. 1A and with reference to FIGS. 6A and 6B, outer ends 29A and 29B of extension sleeves 16A and 16B are located in alignment with outer ends 18A and 18B of side arms 14A and 14B. In these unextended modes the lengths of the linear configurations of extension sleeves 16A and 16B are generally the same as the lengths of the linear configurations of side arms 14A and 14B. In each of the intermediate extended positions of extension sleeves 16A and 16B as shown in FIGS. 1B, 1C and 1D, outer ends 29A and 29B of extension sleeves 16A and 16B are located at proportionately further distances from outer ends 18A and 18B of side arms 14A and 14B. In the fully extended modes of extension sleeves 16A and 16B as shown in FIG. 1E, outer ends 29A and 29B of extension sleeves 16A and 16B are located at their greatest distances from outer ends 18A and 18B of side arms 14A and 14B.

Innermost sleeve locking aperture 32A of extension sleeve 16B is associated with the unextended mode of extension sleeve 16B as seen in FIG. 1A wherein locking pin 24B is positioned in a spring unbiased locked mode in innermost sleeve locking aperture 32A. Locking pin 24B is positioned in a spring biased mode in succeeding intermediate sleeve locking apertures 32B, 32C, 32D and in outermost sleeve locking aperture 32E as shown in FIGS. 1B, 1C, 1D and 1E, respectively. In the spring biased mode, locking pin 24B is withdrawn from side arm 14B bottom side 22B and in the biased mode locking pin 24B is extended past side arm bottom side 22B so as to enter any of the selected sleeve locking apertures 32A-E. Thus, extension sleeve 26B is selectively extendable between a selective innermost mode as seen in FIG. 1A and a selective outermost mode as seen in FIG. 1E with three selective intermediate extension modes of side arm 14B as shown in FIGS. 1B, 1C and 1D, respectively. (See FIG. 10A.)

Locking pin 24A is positioned in a selected one of extension sleeve locking apertures 30A-E in the spring unbiased mode wherein extension sleeve 16A is locked in accordance with the selected one of locking apertures 30A-E. Likewise locking pin 24B is positioned in a selected one of extension sleeve locking apertures 32A-E in the spring unbiased mode wherein extension sleeve 16B is locked in accordance with the selected one of locking apertures 32A-E.

Locking pins 24A and 24B are secured to top side 20A of side arm 14A and top side 20B of side arm 14B, respectively, at a short distance from outer ends 18A and 18B of side arms 14A and 14B respectively. FIGS. 9 and 10 indicate locking pins 24A and 24B located at locking apertures 30A-E and also locking apertures 32A-E. Locking pins 24A and 24B are movable between a spring unbiased mode as shown in FIG. 10 and a spring biased mode as shown in FIG. 10A. In the spring biased mode locking pins 24A and 24B are withdrawn (FIG. 10A) from bottom sides 22A and 22B of side arms 14A and 14B, respectively, and in the spring unbiased mode locking pins 24A and 24B are distanced (FIG. 10) from side wall bottom sides 22A and 22B, respectively.

As seen in FIGS. 1E, 3A, 3B, 4, 5B, 7A, 9, 11 and 11A, a restraining, or bracing pin 34A is mounted to top wall 26A of side arm 14A, and a restraining, or bracing pin 34B is mounted to top wall 20B of side arm 14B. Top wall 26A of extension sleeve 16A defines a bracing pin aperture 36A proximate to sleeve outer end 29A, and top wall 26B of extension sleeve 16B defines a bracing pin aperture 36B proximate to sleeve outer end 29B. Bracing pins 43A and 34B are shown as rectangular but can be cylindrical.

Figure 11:
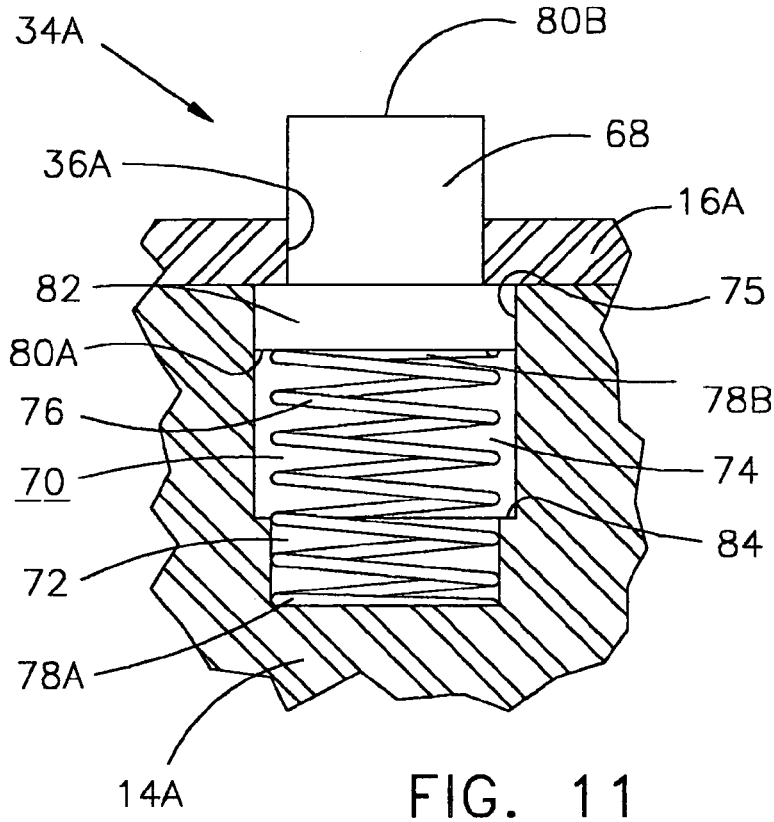
FIG. 11 is a sectional view of the bracing pin in the spring unbiased locked mode taken through line 11-11 in FIG. 9.
Figure 11A:
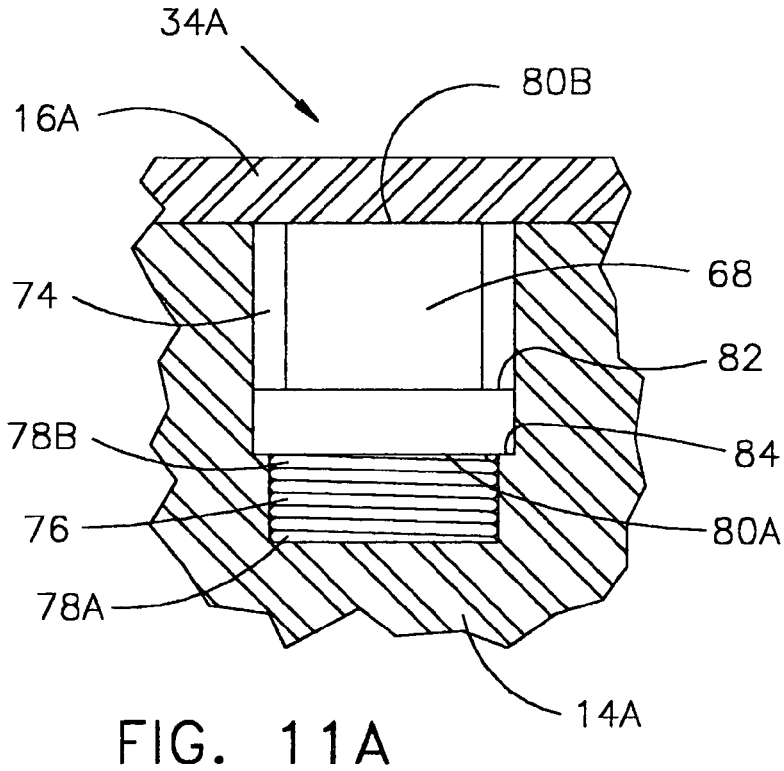
FIG. 11A is a view analogous to the view shown in FIG. 11 with the bracing pin shown in the biased unlocked mode.

Isolated views of bracing pin 34A are shown in FIGS. 11 and 11A. Bracing pin 34A is movable between a spring biased mode and a spring unbiased mode, wherein in the spring unbiased mode bracing pin 34A is positioned in bracing pin aperture 36A, which is located proximate to outer end 18A of extension sleeve 16A. In the spring unbiased mode bracing pin 34A is distanced from top side 20A of side arm 14A in the manner shown in FIGS. 9 and 11 and wherein in the spring biased mode bracing pin 34A is withdrawn from side arm top side 20A as shown in FIG. 11A. Bracing pin 34A is retained in the withdrawn mode as seen in FIGS. 1A-D by top wall 26A of extension sleeve 16A, against which bracing pin 34A is positioned by the spring biased mode of operation shown in FIG. 11A. Bracing pin 34A is positioned in top side bracing pin aperture 36A in association with locking pin 24A being positioned in bottom side locking aperture 30E in the fully extended mode of extension sleeve 16A. Manual pressure against both locking pin 24A and bracing pin 34A results in the movement of both locking pin 34A from locking aperture 30E and also from engagement with extension sleeve 16A and bracing pin 34A from bracing pin aperture 36A thus freeing extension sleeve 16A from restraint and allowing the user to manually slide extension sleeve 16A along side arm 14A to a selected new position at any one of sleeve bottom side apertures 30D, 30C, 30B and 30A.

Isolated views of bracing pin 34B are indicated in FIGS. 9, 11 and 1A. Bracing pin 34B is movable between a spring unbiased mode and a spring biased mode, wherein in the spring biased mode bracing pin 34B is positioned in bracing pin aperture 36B, which is located proximate to outer end 18B of extension sleeve 16B. In the spring unbiased mode bracing pin 34B is distanced from top side 20B of side arm 14B in the manner shown in FIGS. 9 and 11 and wherein in the spring biased mode bracing pin 34B is withdrawn from side arm top side 20B as shown in FIG. 11A. Bracing pin 34B is retained in the withdrawn mode as seen in FIGS. 1A-D by the wall of extension sleeve 16B, against which bracing pin 34B is positioned by the spring biased mode of operation shown in FIG. 11A. Bracing pin 34B is positioned in top side bracing pin aperture 36B in association with locking pin 24B being positioned in bottom side locking aperture 32E in the fully extended mode of extension sleeve 16B. Manual pressure against both locking pin 24B and bracing pin 34B results in the movement of both locking pin 34B from locking aperture 32E and also from engagement with extension sleeve 16B and bracing pin 34B from bracing pin aperture 36B thus freeing extension sleeve 16B from restraint and allowing the user to manually slide extension sleeve 16B along side arm 14B to a selected new position at any one of sleeve bottom side apertures 32A-D.

In the unextended modes of extension sleeves 16A and 16B as shown in FIG. 1A, outer ends 29A and 29B of extension sleeves 16A and 16B are located in general alignment with outer ends 18A and 18B of side arms 14A and 14B wherein in these unextended modes the lengths of the linear configurations of extension sleeves 16A and 16B are generally the same as the lengths of the linear configurations of side arms 14A and 14B. In each of the intermediate extended positions of extension sleeves 16A and 16B as shown in FIGS. 1B, 1C and 1D, outer ends 29A and 29B of extension sleeves 16A and 16B are located at proportionately further distances from outer ends 18A and 18B of side arms 14A and 14B. In the fully extended modes of extension sleeves 16A and 16B as shown in FIG. 1E, outer ends 29A and 29B of extension sleeves 16A and 16B are located at their greatest distances from outer ends 18A and 18B of side arms 14A and 14B.

Locking pin 24A can be positioned in a selected one of extension sleeve locking apertures 30A-E in the spring unbiased mode wherein extension sleeve 16B is locked in accordance with the selected one of locking apertures 32A-E. Manual movement of locking pin 24A away from extension sleeve 16A releases locking pin 24A from engagement with extension sleeve 16A thus allowing extension sleeve 16A to be manually moved relative to side arm 14A.

Likewise, locking pin 24B can be positioned in a selected one of extension sleeve locking apertures 32A-E in the spring unbiased mode wherein extension sleeve 16B is locked in accordance with the selected one of locking apertures 32A-E. Manual movement of locking pin 24B away from extension sleeve 16B releases locking pin 24B from engagement with extension sleeve 16B thus allowing extension sleeve 16B to be manually moved relative to side arm 14B.

Extension sleeve 16A can be moved by being slid relative to side arm 14A only in the event that both locking pin 24A and bracing pin 36A have been moved by manual operation to the spring biased mode so that both are held in the spring biased mode by top and bottom walls 42A and 42B of extension sleeve 14A. Likewise, extension sleeve 16B can be moved by being slid relative to side arm 14B only in the event that both locking pin 24B and bracing pin 36B have been moved by manual operation to the spring biased mode so that both are held in the spring biased mode by top and bottom walls 50A and 50B, respectively, of extension sleeve 14B FIG. 9 and FIGS. 10 and 10A indicates side arm locking pins 24A mounted to bottom side 22A of side arms 14A spaced from outer end 18A of side arms 14A. Locking pins 24A includes button 46A. Button 46A is transversely oriented relative to bottom side 22A of side arm 14A and likewise is transversely oriented relative to bottom walls 28A of extension sleeve 16A. Each locking pin 24A includes side arm 14A defining a holding chamber 48 comprising an inner cylindrical chamber 50 and an axially aligned outer cylindrical chamber 52. Inner cylindrical chamber 50 is dimensioned in diameter and length to accommodate the diameter and length of a helical compression spring 56 positioned therein in the fully biased mode and to accommodate the inner portion of spring 56 in the unbiased mode. Outer cylindrical chamber 52 is greater in diameter than inner cylindrical chamber 50. Locking pins 24A includes locking pin button hole 54A defined by bottom side 22A of side arm 14A that accommodates locking pin button 46A in the unbiased mode. Button hole 54 open to each outer cylindrical chamber 52.

A helical compression spring 56 is positioned in each inner cylindrical chamber 50 in the spring biased mode and is positioned in both inner and outer cylindrical chambers 50 and 52 in the spring unbiased mode.

Each spring 56 is generally of the same length as each inner cylindrical chamber 50 in the spring biased mode and generally of the combined lengths of inner and outer cylindrical chambers 50 and 52 in the unbiased mode. Locking pin 24A, namely button 46 is axially movable in outer cylindrical chamber 52. Button 46 includes a button inner end 60 and a button outer end 60. Button 46 includes a circular stop rim 62, which can be a flexible washer snap-mounted to a groove in buttons 46A and 46B in a manner known in the art.

A circular inward stop ledge 64 is located at the meeting of inner cylindrical chamber 50 and outer cylindrical chamber 52. A button stop rim 62 meets stop ledge 64 in the spring biased mode of spring 56. Side arm 14A defines a button hole 66 where button 46 is positioned at all times. Button hole 66 opens to outer chamber 52 and t0 aperture 30E. In the unbiased mode of spring 56 button hole 66 prevents button from further outward movement as shown in FIG. 10. Spring 56 is moved from the spring unbiased mode shown in FIG. 10 to the spring biased mode shown in FIG. 10A by manual pressure against locking pins 24A and 24B.

During the spring biased mode of spring 56 shown in FIG. 10A, locking pin 24 is maintained in the spring biased mode by sliding or lateral movement of extension sleeves 16 relative to side arms 14A wherein sleeve bottom wall 28A is positioned across pin aperture 36A wherein outward movement of locking pin 24A that might otherwise occur by outward pressure caused by spring 56 is blocked.

During the biased mode of spring 56 shown in FIG. 10, locking pins 24A is maintained in the biased mode after sliding or lateral movement of extension sleeve 16A relative to side arm 14A. At such time bottom wall 28A of extension sleeves 16A is so positioned wherein when any of selected bottom side locking apertures 30A-E or 32A-E is in alignment with locking pin 24A, spring 56 biases so as to push button 46 through the aligned one of extension sleeve apertures 30A-E and beyond bottom wall 28A of extension sleeve 16A. Subsequently, locking pin 24A can be moved by manual operation from the unbiased mode of spring 56 to the spring biased mode of spring 56 as shown in FIG. 10A. The description of locking pin 34A above applies as well to locking pin 34B mutatis mutandis.

FIGS. 11 and 11A generally indicate bracing pin 34A mounted to top side 20A of side arm spaced at a short distance from outer end 18A of side arm 14A so that locking pin 24A is horizontally offset in the fully extended mode of sleeve 16A. Bracing pin 34A includes bracing pin button 68. Bracing pin button 68 is transversely aligned relative to top side 20A of side arm 14A and likewise is transversely aligned with top wall 26A of extension sleeve 16A. As indicated in FIGS. 11 and 11A, bracing pin 34A includes each side arm 14A defining a holding chamber 70 comprising an inner cylindrical chamber 72 and an axially aligned outer cylindrical chamber 74. Outer cylindrical chamber 74 is greater in diameter than inner cylindrical chamber 72. Inner cylindrical chamber 72 is dimensioned in diameter and length to accommodate the diameter and length of a helical compression spring 76 positioned therein in the fully biased mode and to accommodate the inner portion of spring 76 in the unbiased mode. Bracing pin 34A includes bracing pin button hole 75 defined by side arm 14A that accommodates button 68A in all modes. Button hole 75 opens to each outer cylindrical chamber 74.

Each spring 76 is generally of the same length as each inner cylindrical chamber 72 in the spring biased mode and generally of the combined lengths of inner and outer cylindrical chambers 72 and 74 in the spring unbiased mode. Button 68 is axially movable in outer cylindrical chamber 74. Button 68 includes a button inner end 80 and a button outer end 80. Each button inner end 80 includes a circular stop rim 82.

A circular inward stop ledge 84 that is located between inner cylindrical chamber 72 and outer cylindrical chamber 74 meets button inward end stop rim 82 in the spring biased mode of spring 76. Bracing pin aperture 36A opens to outer chamber 74 at bracing pin button holes 75 wherein top wall 20A of side arm 18A at aperture 36A prevents bracing pin 34A from further outward movement as shown in FIG. 11. Spring 76 is moved from the unbiased mode shown in FIG. 11 to the spring biased mode shown in FIG. 11A by manual pressure against buttons 68A.

During the spring biased mode of spring 76 shown in FIG. 11A, bracing pin 34A is maintained in the spring biased mode during sliding or lateral movement of extension sleeve 16A relative to side arm 14A wherein sleeve 16A is positioned across restraining pin button holes 75 which block outward movement of button 68 that might otherwise occur by outward biasing pressure caused by spring 76. The description above relating to bracing pin 34A applies as well to bracing pin 34B mutatis mutandis.

Figure 12:
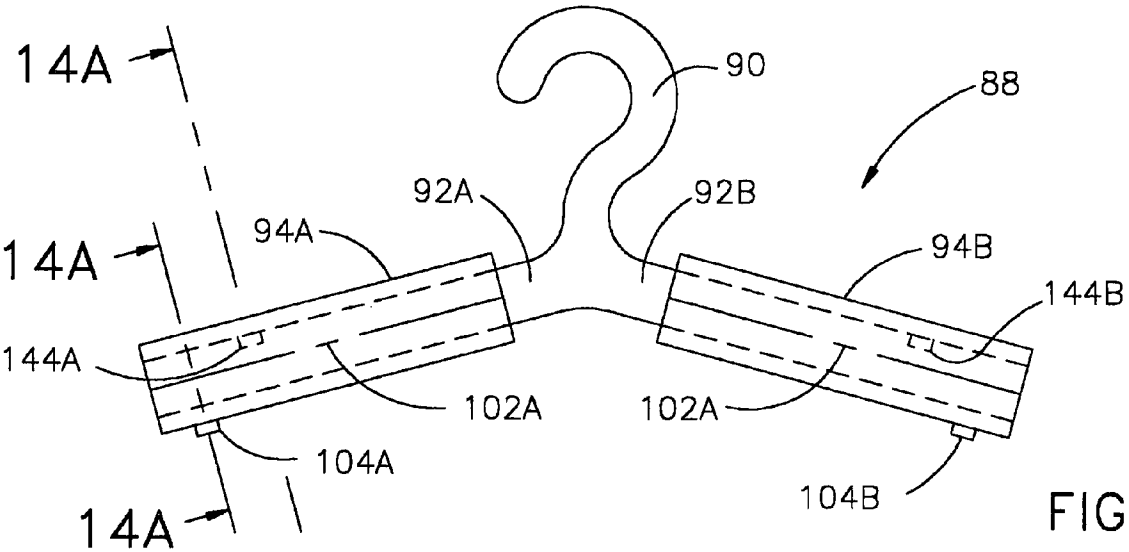
FIG. 12 is a front elevation view of the another embodiment of the clothes hanger in accordance with the present invention showing cylindrical left and right side arms and cylindrical left and right extension sleeves in an unextended mode.
Figure 13:
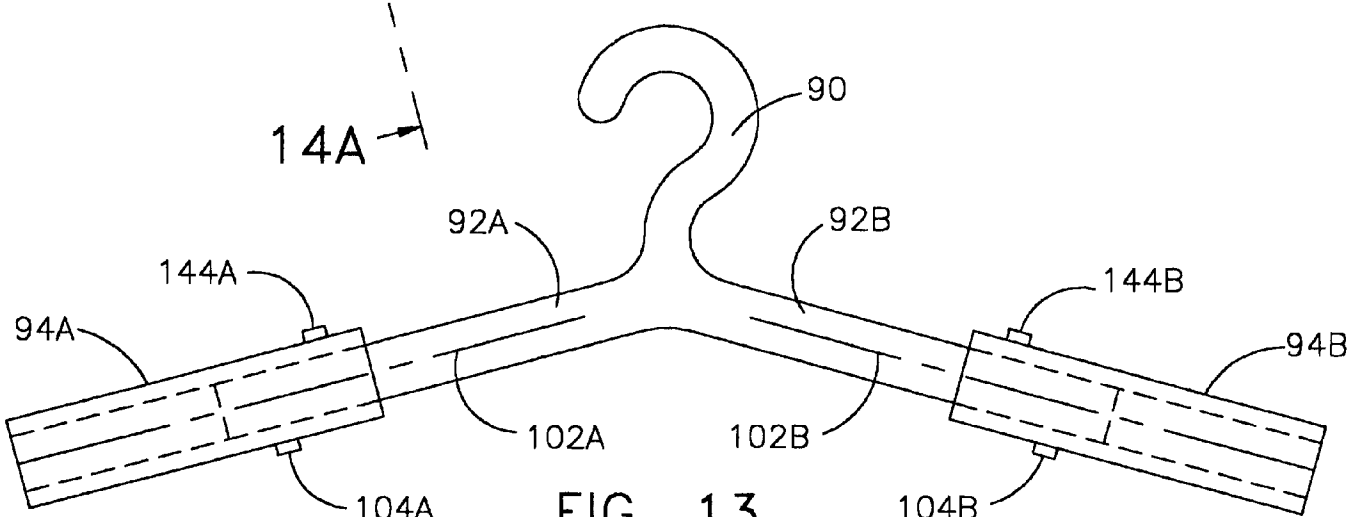
FIG. 13 is a front elevation view of the invention analogous to the embodiment of FIG. 12 showing the left and right cylindrical extension sleeves extending from the cylindrical left and right side arms in a fully extended mode.

As shown in FIGS. 12, 13, 14A, 14B, 15A, 15B, 16A, 16B, 17A, 17B, 18, 19, 20 and 21, an alternative embodiment of the present invention is an extendable clothes hanger 88 including a hook portion 90 and a left linear side arm 92A and an opposed right linear side arm 92B that are both connected to hook portion 90. A linear extension sleeve 94A slidably mounted to side arm 92A is movable between an inward unextended mode as shown in FIG. 12 and an outward fully extended mode as shown in FIG. 13. A linear extension sleeve 94B slidably mounted to side arm 92B is movable between an inward unextended mode as shown in FIG. 12 and an outward fully extended mode as shown in FIG. 13. Side arms 92A and 92B are shown angled slightly downwardly relative to the horizontal in a manner known in the art.

Linear extension sleeves 94A and 94B can be positioned relative to side arms 92A and 92B in five positions that are analogous to the five positions of extension sleeves 16A and 16B of clothes hanger 10 as shown in FIGS. 1A, 1B, 1C, 1D and 1E. Thus, extension sleeves 94A and 94B can also be positioned in three intermediate positions between the unextended and the fully extended modes analogous to the three intermediate extension mode positions of extension sleeves 16A and 16B of hanger 10 as shown in FIGS. 1B, 1C and 1D.

Figure 14A:
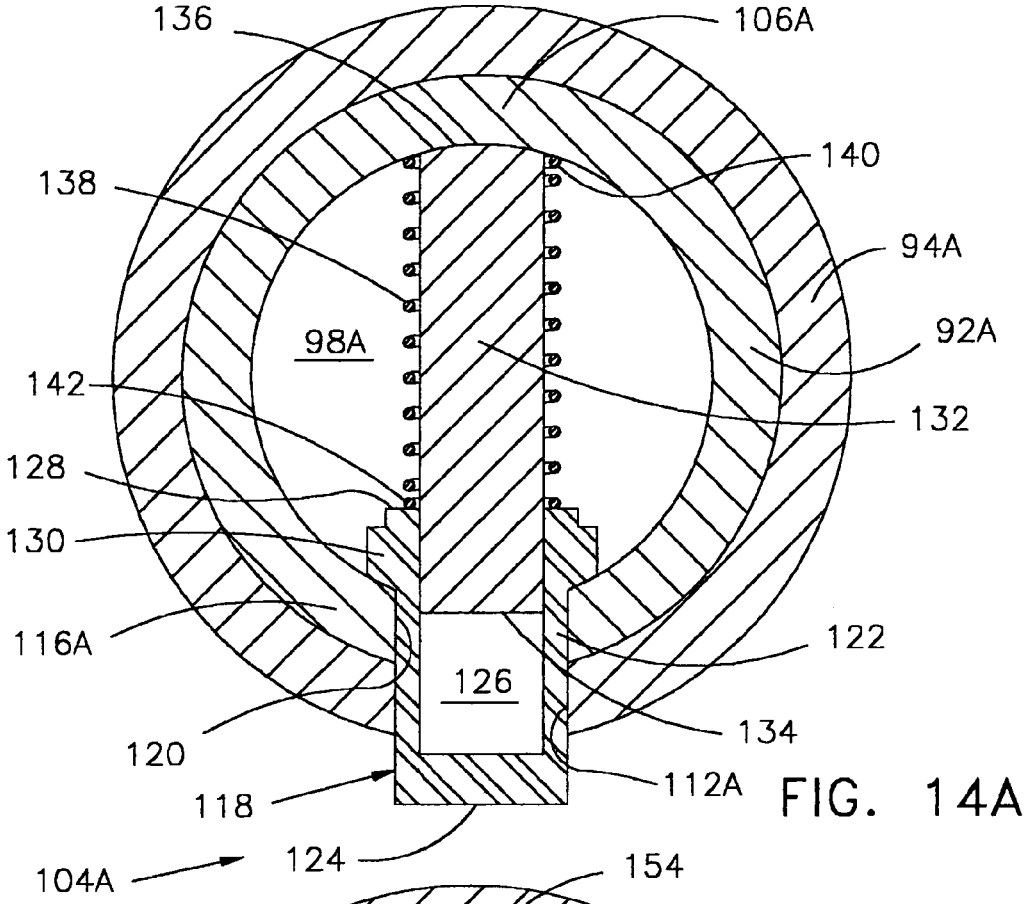
FIG. 14A is a cross-sectional view of the cylindrical left side arm and cylindrical right side arm extension sleeve and locking pin taken through line 14A-14A in FIG. 13.
Figure 14B:
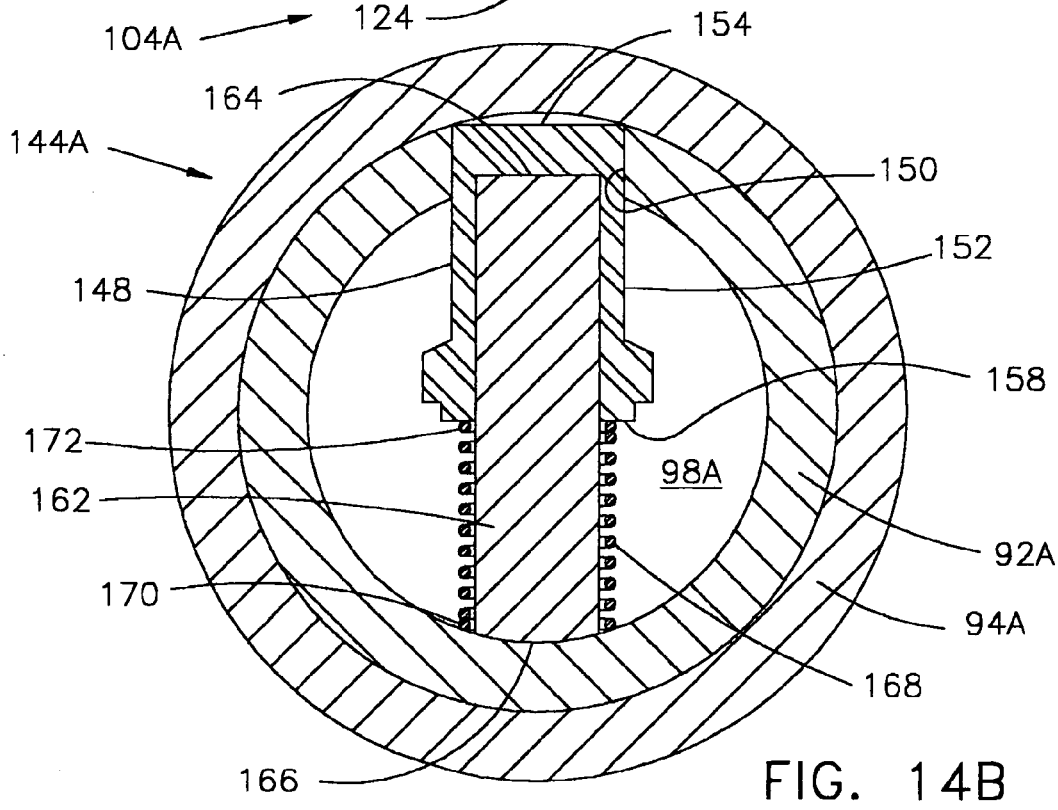
FIG. 14B is a cross-sectional view of the cylindrical right side arm and cylindrical right side arm extension sleeve and bracing pin taken through line 14B-14B in FIG. 13
Figure 15B:
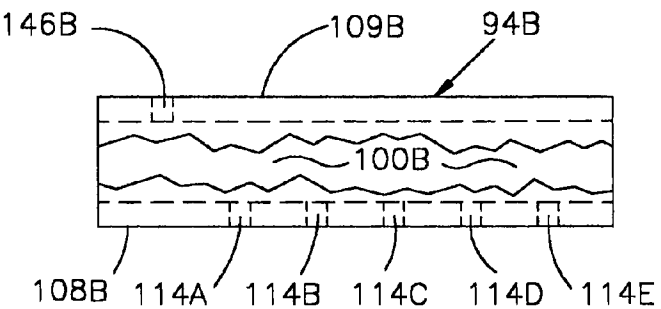
FIG. 15B is a broken side view taken in isolation of the right extension sleeve shown in FIG. 12 showing the cylindrical space formed by the right sleeve.
Figure 15A:
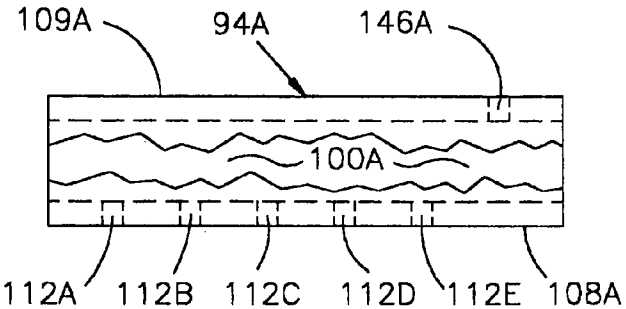
FIG. 15A is a broken side view taken in isolation of the left extension sleeve shown in FIG. 12 showing the cylindrical space formed by the left sleeve.

Linear side arms 92A and 92B are cylindrical each including cylindrical walls 96A and 96B, respectively, that form cylindrical spaces with cylindrical space 98A shown as in FIGS. 14A and 14B, respectively, which is representative of the cylindrical space formed by cylindrical wall 96B.

Linear extension sleeves 94A and 94B are likewise cylindrical having cylindrical walls 100A and 100B, respectively, that have inner diameters that are slightly larger than the outer diameters of cylindrical walls 96A and 96B so that extension sleeves 94A and 94B are slidably movable relative to side arms 92A and 92B. Cylindrical walls 96A and 100A have a common centerline 102A and cylindrical walls 96B and 100B have a common centerline 102B.

FIGS. 12, 13, 14A, 17 and 18 show locking pins 104A and 104B. Locking pin 104A is shown in detail in FIGS. 14A, 18 and 19 secured to the top sides 106A and 106B of side arms 92A and 92B and movable relative to the bottom sides 116A and 116B of side arms 92A and 92B, respectively, proximate to side arm outer end 110A, which is representative of locking pin 104B relative to side arm 92B. Locking pins 104A and 104B are movable relative to locked and unlocked modes across cylindrical spaces 98A and 98B transversely through common centerlines 102A and 102B of cylindrical side arms 92A and 92B and cylindrical sleeves 100A and 100B, respectively.

Figure 16B:
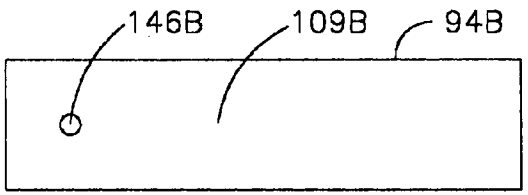
FIG. 16B is a top view of the right side cylindrical extension sleeve shown in FIG. 15B.
Figure 16A:
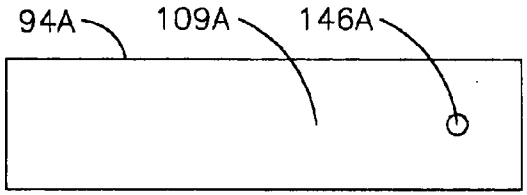
FIG. 16A is a top view of the left side cylindrical extension sleeve shown in FIG. 15A.
Figure 17B:
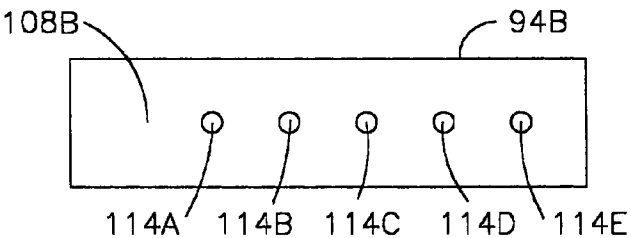
FIG. 17B is a bottom view of the right side cylindrical extension sleeve shown in FIG. 15B.
Figure 17A:
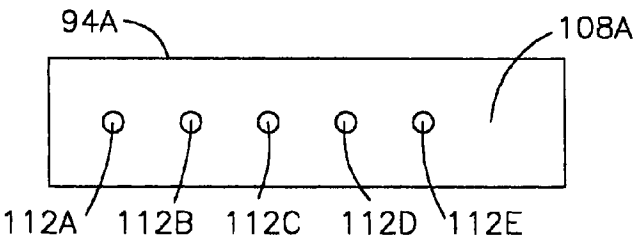
FIG. 17A is a bottom view of the left side cylindrical extension sleeve shown in FIG. 15A.

As seen in FIGS. 16A and 16B, bottom side 108A of cylindrical wall 100A of sleeve 94A and cylindrical wall 100B of sleeve 108B, respectively, each define five equally spaced locking pin apertures 112A, 112B, 112C, 112D and 114E, and 114A, 114B, 114C, 114D and 114E, respectively. Locking pin 104A in the spring biased mode extends through a selected one of apertures 112A-E, and locking pin 104B in the spring biased mode extends through a selected one of apertures 114A-E, wherein extension sleeves 94A and 94B are locked with side arms 92A and 92B, respectively, relative to the selected pin apertures.

Figure 18:
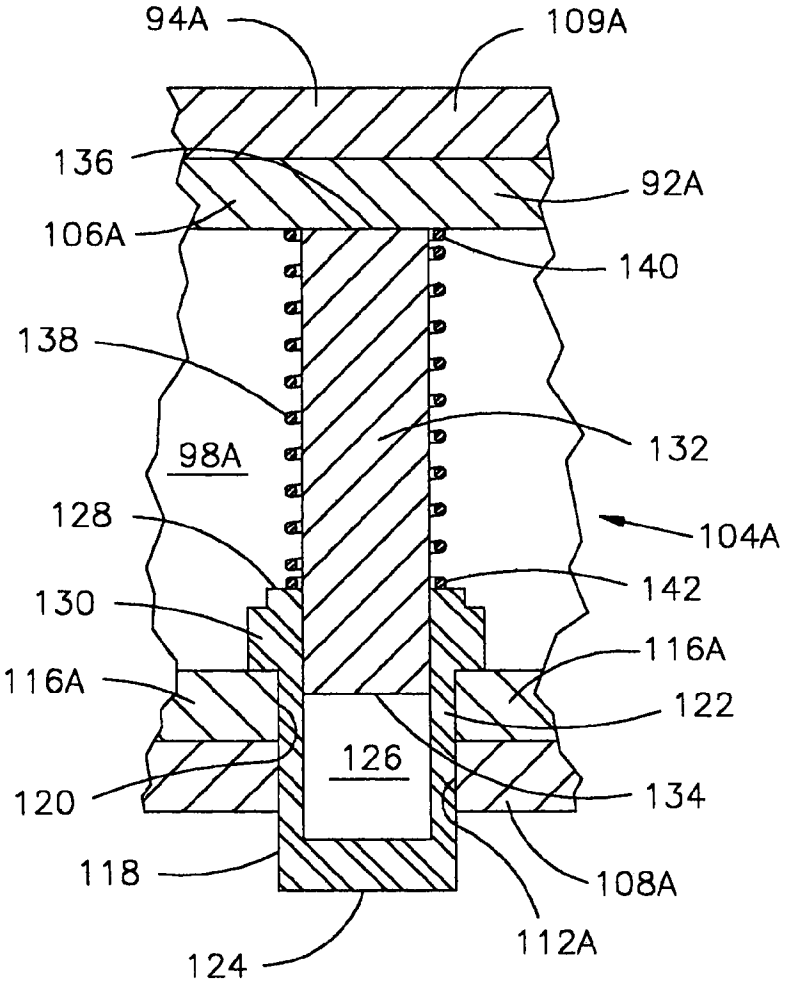
FIG. 18 is a sectional view of a locking pin in a locked mode with the spring in an unbiased mode taken lateral to and aligned with the centerline of the side arm and sleeve in FIG. 12.
Figure 21:
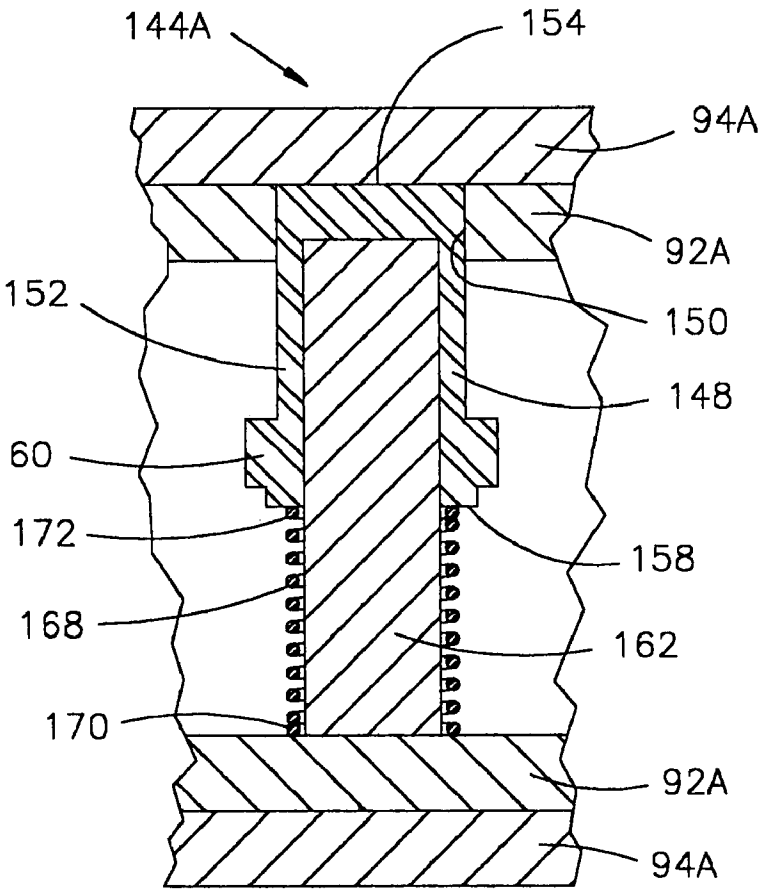
FIG. 21 is a sectional view of the bracing pin shown in FIG. 20 with the locking pin in an unlocked mode with the spring in a biased mode.

FIG. 17 shows locking pin 104A, which is representative of locking pin 104B, in the spring unbiased locked mode and FIG. 18 shows locking pin 112 in the spring biased unlocked mode. Locking pin 104A is also shown in FIG. 14A extending transversely and diametrically through cylindrical space 98A defined by cylindrical wall 96A of side arm 92A. Locking pin 104B by analogy extends transversely and diametrically through cylindrical a space defined by cylindrical wall 96B of side arm 92B. Locking pin 104A is secured to top side 106A of side arm 92A proximate to side arm outer end 110A. Locking pin 104A is movable between the locked and unlocked modes transverse to the common centerline 102A of cylindrical side arm 92A and cylindrical extension sleeve 100A, and likewise locking pin 104B is movable between the locked and unlocked modes transverse to the common centerline 102B of cylindrical side arm 92B and cylindrical extension sleeve 100B.

Figure 19:
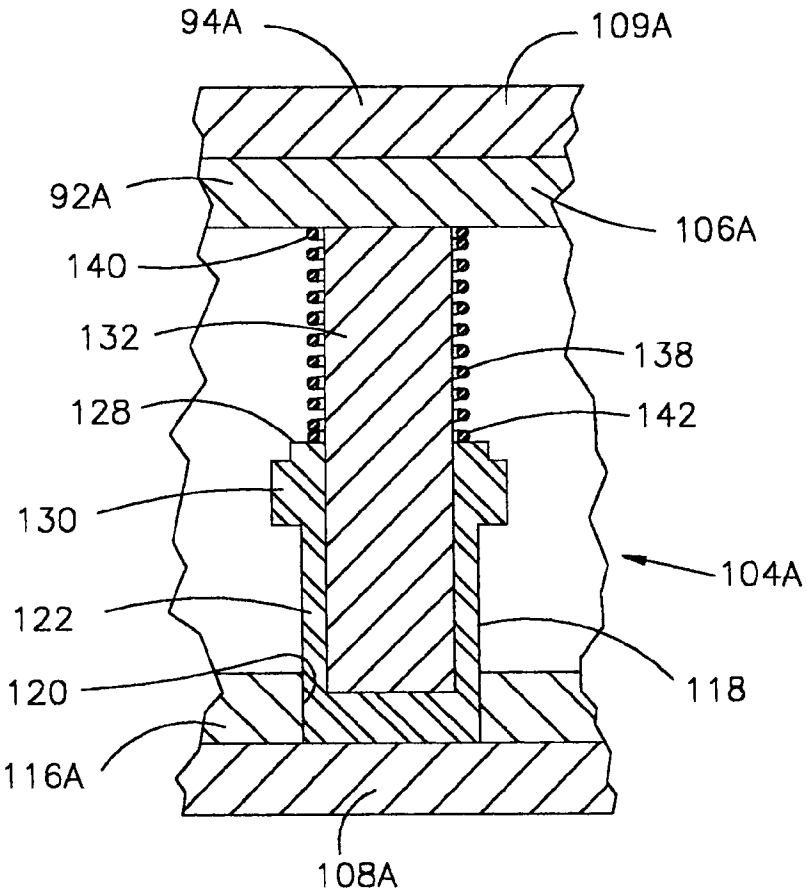
FIG. 19 is a sectional view of the locking pin shown in FIG. 18 with the locking pin in an unlocked mode with the spring in a biased mode.

As seen in FIGS. 1 and 19 locking pin 104A includes a button 118 that extends through a button hole 120 defined in bottom side 116A of side arm 92A in which button 118 is slidably positioned in all modes. Button includes a cylindrical side wall 122, an outer end wall 124 together defining a cylindrical compartment 126, an inner circular edge 128 and a circular stop flange 130 extending outwardly from side wall 122 proximate to circular edge 128. Stop flange 130 optionally can be a circular washer snap-mounted to cylindrical side wall 122 in a manner known in the art. A cylindrical post 132 includes a free end 134 and a fixed end 136 secured to top 106A of side arm 92A.

A helical compression spring 138 is slidably mounted around post 132 between secured end 136 and inner circular edge 128. Spring 138 includes a spring top mount 140 pressed against side arm 92A and a circular bottom mount 142 pressed against stop flange 130.

In the unbiased locked mode of FIG. 17, locking button 118 extends through button hole 120 and also through the selected one of locking apertures 112A-E indicated as locking aperture 112X so that locking pin 104A locks cylindrical wall 100A of extension sleeve 94A to cylindrical wall 96A of side arm 92A. In the spring biased locking mode of FIG. 18, locking button 118 preferably remains positioned in button hole 120.

In operation, in the spring biased locked mode shown in FIG. 17, the operator can press locking button 118 inwardly into the spring biased unlocked mode wherein spring 138 is forced from the spring biased mode of FIG. 17 to the spring biased mode of FIG. 18 wherein locking button 118 is moved from locking aperture 112X. At such time the operator slides sleeve 94A relative to side arm 92A to a new alignment of sleeve 94A in particular to a new alignment of button 118 into another locking aperture selected from locking apertures 112A-E. When that alignment is made, locking button 118 is biased into the unbiased mode through the new locking aperture 112X such as that seen in FIG. 17 and sleeve 94A is locked with side arm 92A. When sleeve 94A is slid along side arm 92A in the arrangement seen in FIG. 18 and locking button 118 is self-biased into an unselected locking aperture, the operator again presses locking button 118 into the spring biased mode and continues sliding sleeve 94A relative to side arm 92A to the desired alignment wherein locking button 118, namely, locking pin 104A moves into position in the new locking pin aperture 112A-E as the case might be.

Figure 20:
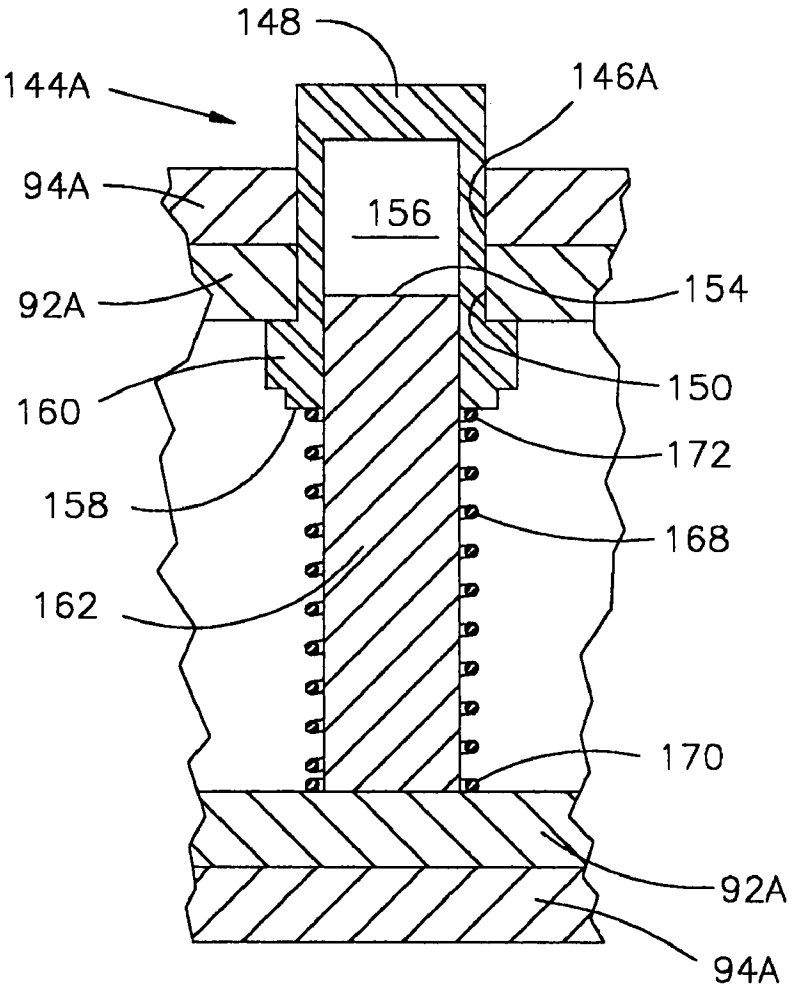
FIG. 20 is a sectional view of a bracing pin in a locked mode with the spring in an unbiased mode taken lateral to and aligned with the centerline of the side arm and sleeve in FIG. 12.

FIGS. 12, 13, 14B, 19 and 20 show opposed bracing pins 144A and 144B that are secured to bottom sides 116A and 116B of side arms 92A and 92B, respectively, slightly inwardly relative to locking pins 104A and 104B, respectively, and to side arms outer ends 110A and 110B, respectively. Bracing pins 144A and 144B are positioned transverse to centerlines 102A and 102B of cylindrical side arms 92A and 92B. FIG. 19 shows bracing pin 144A in the spring unbiased locked mode and FIG. 20 shows bracing pin 144A in the spring biased locked mode. Bracing pin 144A is secured to bottom side 116A of side arm 102A proximate to side arm outer end 110A.

Bracing pin 144A as shown in FIGS. 19 and 20 includes a cylindrical button 148 that is positioned in a button hole 150 defined by top side 106A of side arm 92A wherein button 148 is positioned in all modes. Button 148 includes a cylindrical side wall 152, a button outer end wall 154 together defining a cylindrical compartment 156, a button inner circular end 158, a button inner circular stop flange 160 extending outwardly from side wall 152 proximate to inner circular end 158. Stop flange 160 optionally can be a circular washer snap-mounted to button side wall 152 in a manner known in the art. A cylindrical post 162 includes a free end portion 164 slidably mounted in cylindrical compartment 156 and an opposed end 166 secured to bottom 116A of side arm 92A.

A helical compression spring 168 is slidably mounted around post 162 between post secured end 166 and button circular stop flange 160. Spring 168 includes a spring circular bottom end 170 secured to bottom side 116A of side arm 92A and a spring circular top end 172 in contact with stop flange 160.

In the spring unbiased locked mode of FIG. 19, button 148 extends through button hole 150 and also through button hole 150. In this mode, bracing pin 144A locks cylindrical wall 100A of extension sleeve 94A to cylindrical wall 96A of side arm 92A. In the spring biased locked mode of FIG. 19, button 150 of bracing pin 144A preferably remains positioned in button hole 148. In the locked mode of bracing pin 144A, button stop flange 160 limits button 150 from further movement as button stop flange 160 is pressed against top side 106A of side arm 92A as spring 168 biases button 150 upwardly through bracing pin aperture 146A.

In operation, when bracing pin 144A is in the spring unbiased locked mode shown in FIG. 19 and the unlocked mode of bracing pin 144A is desired, the operator presses button 150 inwardly, or downwardly, wherein spring 168 is forced to the spring biased unlocked mode of FIG. 20 wherein button 148 is moved out of bracing pin aperture 146A. At such time the operator slides extension sleeve 94A relative to side arm 92A to a new alignment of sleeve 94A that is dependent upon the operator's selection of the placement of locking pin 104A into one of locking pin apertures 112A-E as generally shown in FIG. 17. Extension sleeve 94A can be slid relative to side arm 92A only when both locking pin 104A and bracing pin 144A are both in their respective unlocked modes as shown in FIGS. 18 and 20, respectively.

When, however, an alignment of locking pin 104A with locking pin aperture 120E is made and locking pin 104A moves through aperture 120E into the locking mode shown in FIG. 17, bracing pin 144A at that time is biased through bracing pin aperture 146A into the bracing pin locked mode shown in FIG. 19. As sleeve 94A is slid along side arm 92A, if button 118 of locking pin 104A is spring biased into a selected locking pin aperture that has not been selected, the operator again presses locking button 118 into the spring biased mode shown in FIG. 17 and continues sliding sleeve 94A relative to side arm 92A to the desired alignment wherein locking pin 104A, namely button 118, is positioned in the selected locking pin aperture 112A-E as the case might be. Only when locking pin 104A is in the locked mode in aperture 120E is bracing pin 144A positioned in the locked mode as shown in FIG. 19. In all other positions of locking pin 104A, bracing pin 144A is in the spring biased unlocked mode as shown in FIG. 20. The details of bracing pin 144A as described hereinabove are analogous to bracing pin 144B mutatis mutandis.

Other embodiments or modifications may be suggested to those having the benefit of the teachings therein, and such other embodiments or modifications are intended to be reserved especially as they fall within the scope and spirit of the subjoined claims. For example, locking pins mounted to the side arms described herein as being responsive to biasing means can, for example, be threaded locking pins having holding rims and can pass through the apertures on the extension sleeves and be threaded into threaded recesses in the side arms.

What is claimed is:

1. An extendable clothes hanger comprising, a hook portion, a first rigid side arm connected to said hook portion and having a first arm top side and a first arm bottom side, a second rigid side arm connected to said hook portion and having a second arm top side and a second arm bottom side, a first sleeve slidably mounted to said first side arm movable between a first sleeve unextended mode and at least one first sleeve extended mode, wherein said first sleeve extended mode includes at least one first sleeve fully extended mode, said first sleeve having a first sleeve top side and a first sleeve bottom side, a second sleeve slidably mounted to said second side arm movable between a second sleeve unextended mode and at least one second sleeve extended mode, wherein said second sleeve extended mode includes at least one second sleeve fully extended mode, said second sleeve having a second sleeve top side and a second sleeve bottom side, first means for locking said first sleeve to said bottom side of said first side arm wherein said first sleeve is prevented from lateral movement relative to said first side arm in a selected one of said first sleeve unextended mode and said at least one first sleeve extended mode wherein said first sleeve is immovable relative to said first side arm, said first means for locking being mounted to said first side arm bottom side, first means for unlocking said first sleeve from said first side arm wherein said first sleeve is laterally movable relative to said first side arm, second means for locking said second sleeve to said bottom side of said second side arm wherein said second sleeve is prevented from lateral movement relative to said second side arm in a selected one of said second sleeve unextended mode and said at least one second sleeve extended mode wherein said second sleeve is immovable relative to said second side arm, said second means for locking being mounted to said second side arm bottom side, second means for unlocking said second sleeve from said second side arm wherein said first sleeve is laterally movable relative to said first side arm, first means for bracing said first sleeve from downward transverse movement relative to said first side arm when said first sleeve is in said first sleeve fully extended mode, said first means for bracing being associated with said first sleeve fully extended mode and including said top side of said first sleeve defining a first sleeve bracing pin aperture, said first means for bracing including a first bracing pin connected to said top side of said first side arm, said first bracing pin being positioned in said first sleeve bracing pin aperture second means for bracing said second sleeve from downward transverse movement relative to said second side arm when said second sleeve is in said second sleeve fully extended mode, said second means for bracing being associated with said second sleeve fully extended mode and including said top side of said second sleeve defining a second sleeve bracing pin aperture, said second means for bracing including a second bracing pin connected to said top side of said second side arm, said second bracing pin being positioned in said second sleeve bracing pin aperture, first means for unbracing said first sleeve from downward transverse movement relative to said second side arm, second means for unbracing said second sleeve from downward transverse movement relative to said second side arm, said first bracing pin being movable between a first bracing pin braced mode and a first bracing pin unbraced mode, wherein in said first bracing pin braced mode said first bracing pin is engaged with said first sleeve top side bracing pin aperture wherein said first sleeve is restrained from transverse downward movement relative to said first side arm, and wherein in said first bracing pin unbraced mode said first bracing pin is withdrawn from engagement with said first sleeve top side aperture and engagement with said first sleeve, said second bracing pin being movable between a second bracing pin braced mode and a second bracing pin unbraced mode, wherein in said second bracing pin braced mode said second bracing pin is engaged with said second sleeve top side bracing pin aperture wherein said second sleeve is restrained from transverse downward movement relative to said second side arm, and wherein in said second bracing pin unbraced mode said second bracing pin is withdrawn from engagement with said second sleeve top side aperture and engagement with said second sleeve, said first bracing pin including first bracing pin biasing means relative to the movement of said first bracing pin between a first bracing pin biased mode and a first bracing pin unbiased mode, wherein in said first bracing pin biased mode said first bracing pin is withdrawn from said first sleeve bracing pin and said first bracing pin is positioned in said first sleeve bracing pin aperture, said second bracing pin including second bracing pin biasing means relative to the movement of said second bracing pin between a second bracing pin biased mode and a second bracing pin unbiased mode, wherein in said second bracing pin biased mode said second bracing pin is in withdrawn from said second sleeve bracing pin aperture and said second bracing pin is positioned in said second sleeve bracing pin aperture, and wherein said first and said second bracing pins are positioned in said first and second bracing pin apertures, respectively, when said first and second biasing means are activated to an unbiased mode wherein said first and said second sleeves are prevented from downward transverse movement relative to said first and second side arms, respectively.

2. The extendable clothes hanger according to claim 1, said first bracing pin biasing means including said first bracing pin defining a first bracing pin chamber and further including a first bracing pin compression spring positioned in said chamber, said first bracing pin being operationally movable between said first bracing pin unbraced mode and said first bracing pin braced mode, respectively, in response to operation of said first biasing means, and said second bracing pin biasing means including said second bracing pin defining a second bracing pin chamber and further including a second bracing pin compression spring positioned in said chamber, said second bracing pin being operationally movable between said second bracing pin unbraced mode and said second bracing pin braced mode, respectively, in response to operation of said second biasing means.

3. The extendable clothes hanger according to claim 1, wherein said first means for locking and unlocking includes a first locking pin mounted to said first side arm bottom side, said first locking pin being movable between a first locking pin locked mode and a first locking pin unlocked mode, wherein in said first locking pin locked mode said first locking pin is engaged with said first sleeve wherein said first sleeve is restrained from lateral movement relative to said first side arm, and wherein in said first locking pin unlocked mode said first locking pin is withdrawn into said side arm bottom side and disengaged from said first sleeve into said first locking pin unlocked mode and said first sleeve is laterally movable relative to said first side arm, said second means for locking and unlocking including a second locking pin mounted to said second side arm bottom side, said second locking pin being movable between a second locking pin locked mode and a second locking pin unlocked mode, wherein in said second locking pin locked mode said second locking pin is engaged with said second sleeve wherein said second sleeve is restrained from lateral movement relative to said second side arm, and wherein in said second locking pin unlocked mode said second locking pin is withdrawn into said side arm bottom side and disengaged from said second sleeve and said first sleeve is laterally movable relative to said first side arm.

4. The extendable clothes hanger according to claim 3, wherein said first sleeve bottom side defines at least two first sleeve bottom side locking pin apertures including a first sleeve locking pin aperture associated with said first sleeve fully extended mode, wherein when said first locking pin is positioned in a selected one of said at least two first sleeve locking pin apertures wherein said first sleeve is locked from lateral movement relative to said first side arm, and wherein said second sleeve bottom side defines at least two second sleeve bottom side locking pin apertures including a second sleeve locking pin aperture associated with said first sleeve fully extended mode, wherein when said second locking pin is positioned is a selected one of said at least two second sleeve bracing pin apertures wherein said second sleeve is locked from lateral movement relative to said second side arm.

5. The extendable clothes hanger according to claim 4, wherein said first locking pin includes first locking pin biasing means relative to the movement of said first locking pin between a first locking pin biased mode and a first locking pin unbiased mode, wherein in said first locking pin biased mode said first locking pin is withdrawn from said first sleeve locking pin aperture and in said first locking pin unbiased mode said first locking pin is positioned in said first locking pin aperture, and wherein said second locking pin includes second locking pin biasing means relative to the movement of said second locking pin between a second locking pin biased mode and a second locking pin unbiased mode, wherein in said second locking pin biased mode said second locking pin is withdrawn from said second sleeve locking pin aperture and in said second locking pin unbiased mode said second locking pin is positioned in said second locking pin aperture.

6. The extendable clothes hanger according to claim 5, said first locking pin biasing means including said first locking pin defining a first locking pin chamber and further including a first locking pin compression spring positioned in said first locking pin chamber, said first locking pin being operationally movable between said first locking pin unlocked mode and said first locking pin locked mode, respectively, in response to operation of said first locking pin biasing means, and said second locking pin biasing means including said second locking pin defining a second locking pin chamber and further including a second locking pin compression spring positioned in said second locking pin chamber, said second locking pin being operationally movable between said second locking pin unlocked mode and said second locking pin locked mode, respectively, in response to operation of said second locking pin biasing means.

7. The extendable clothes hanger according to claim 4, further including a plurality of first sleeve bottom side intermediate apertures located between said first sleeve bottom side inward aperture and said first sleeve bottom side outward aperture, and further including a plurality of second sleeve bottom side intermediate apertures located between said second sleeve bottom side inward aperture and said second sleeve bottom side outward aperture.

8. The extendable clothes hanger according to claim 1, wherein said first side arm and said second side arm are linear in configuration and wherein said first sleeve and said second sleeve are linear in configuration.

9. The extendable clothes hanger according to claim 1, wherein said first side arm and said first sleeve are angled downwardly relative to the horizontal and said second side arm and said second sleeve are angled downwardly relative to the horizontal.

10. The extendable clothes hanger according to claim 1, wherein said at least one first sleeve extended mode is a plurality of first sleeve extended modes between said first sleeve unextended mode and said first sleeve fully extended mode and wherein said at least one second sleeve extended mode is a plurality of second sleeve extended modes between said first sleeve unextended mode and said first sleeve fully extended mode.

11. The extendable clothes hanger according to claim 7, wherein said first means for bracing is operable relative to said first sleeve in said fully extended mode of said first sleeve, and wherein said second means for bracing is operable relative to said second sleeve in said fully extended mode of said second sleeve.

* * * * *